United States Patent [19]

Parker

[11] Patent Number: 4,922,980

[45] Date of Patent: May 8, 1990

[54] COMPUTER KEYBOARD COVER

[76] Inventor: Laura Parker, 1235 DeHaro St., San Francisco, Calif. 94107

[21] Appl. No.: 386,524

[22] Filed: Jul. 27, 1989

[51] Int. Cl.[5] ..... B65D 65/02; B65D 65/10; B41J 29/00

[52] U.S. Cl. ..... 150/165; 206/320; D14/114

[58] Field of Search ..... 150/165, 154; 206/320; D14/114, 115; 364/189, 708; 400/679, 713, 719, 693; 264/DIG. 40, 160; 84/183

[56] References Cited

U.S. PATENT DOCUMENTS

| | | | |
|---|---|---|---|
| Re. 20,959 | 1/1939 | Rovee et al. | 150/165 |
| D. 237,754 | 11/1975 | Ray, Jr. | D14/114 |
| D. 237,755 | 11/1975 | Ray, Jr. | D14/114 |
| D. 260,202 | 8/1981 | Middleton, Jr. | D14/114 X |
| D. 265,561 | 7/1982 | Cottrell | D14/114 |
| 2,492,262 | 12/1949 | Boyden et al. | 150/165 X |
| 2,958,357 | 11/1960 | Vorgan | 150/165 X |
| 3,072,006 | 1/1963 | Jurkowski | 84/183 |
| 3,426,115 | 2/1969 | Taber | 264/160 |
| 3,454,075 | 7/1969 | Weinstein | 150/165 X |
| 4,283,362 | 8/1981 | Gold | 264/DIG. 40 X |

*Primary Examiner*—Sue A. Weaver
*Attorney, Agent, or Firm*—Townsend and Townsend

[57] ABSTRACT

A cover for a computer keyboard comprises a sheet of elastic elastomeric material such as polyester film of sufficient length and width to cover a keyboard, which is of sufficient rigidity to retain a cylindrical shape when rolled and to cover the keyboard top and at least two opposing sides of the keyboard when unrolled. The cover is formed by rolling the sheet into a tight roll and then heating the rolled sheet for a sufficient time at a sufficient temperature such that when cooled, it will possess a curl characteristic retaining memory of its rolled condition, then cooling the material. The sheet may be formed in a roll which is oriented to extend and roll up from either the left hand side or right hand side of the keyboard. The two long edges extend past the edges and grip the side or underside of the keyboard. In another embodiment, the sheet is cut to form a roll which is oriented top to bottom relative to the keyboard face or front. The keyboard cover will roll automatically into a compact, conveniently-storable roll. An adhesive strip may be provided along one edge in order to hold it against the keyboard when the cover is not in use.

6 Claims, 2 Drawing Sheets

COMPUTER KEYBOARD COVER

BACKGROUND OF THE INVENTION

This invention is for use to protect a keyboard of a computer terminal, and more particularly to cover a removable keyboard.

A dust cover for a keyboard is a common accessory for a computer. Heretofore, dust covers have taken the form of a form-fitting flexible plastic sheet. While well-suited to protecting against dust and the like, storage is often inconvenient as the cover must be folded manually to minimize storage space.

What is needed is a cover for a computer keyboard which is easy and convenient to store, requires a minimum of storage space and yet which is convenient to install and use.

SUMMARY OF THE INVENTION

According to the invention, a cover for a computer keyboard comprises a sheet of elastic elastomeric material such as polyester film of sufficient length and width to cover a keyboard, which is of sufficient rigidity to retain a cylindrical shape when rolled and to cover the keyboard top and at least two opposing sides of the keyboard when unrolled. Further according to the invention, the plastic sheet is formed by rolling the sheet into a tight roll and then heating the rolled sheet for a sufficient time at a sufficient temperature such that when cooled, it will possess a curl characteristic retaining memory of its rolled condition, then cooling the material. Several embodiments are contemplated. In a first embodiment, the sheet is cut to form a roll which is oriented to extend and roll up from either the left hand side or right hand side of the keyboard. The two long edges extend past the edges and grip the side or underside of the keyboard. In another embodiment, the sheet is formed in a roll which is oriented top to bottom relative to the keyboard face or front. In either embodiment, the keyboard cover will roll automatically into a compact, conveniently-storable roll which is readily stored beside the keyboard, under the keyboard, or elsewhere, such as in a tube or a pencil holder. An adhesive strip may be provided along one edge in order to hold it against the keyboard when the cover is not in use.

The invention will be better understood by reference to the following detailed description in conjunction with the accompanying drawings.

DESCRIPTION OF THE SPECIFIC EMBODIMENTS

Figure 1:
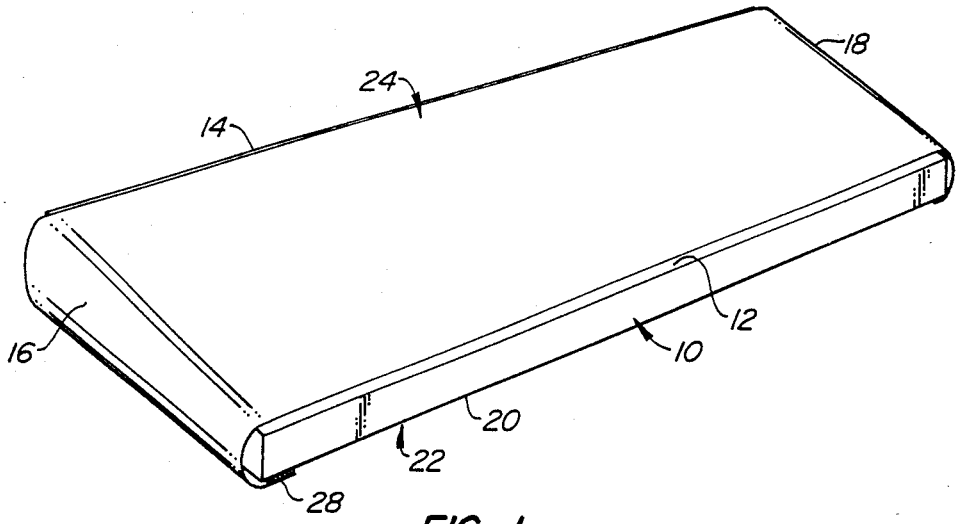
FIG. 1 is a first perspective view of a first embodiment of the invention covering a personal computer keyboard.

With reference to FIG. 1, a typical removable computer terminal keyboard 10 has a rectangular front or face side 12, a top edge 14, a left side margin 16, a right side margin 18, a bottom edge 20 and an underside 22. There is a thickness to the keyboard 10 between the face side 12 and the underside 22 which is uniform to slightly wedge-shaped. It is this keyboard shape for which the present invention is designed.

Figure 2:
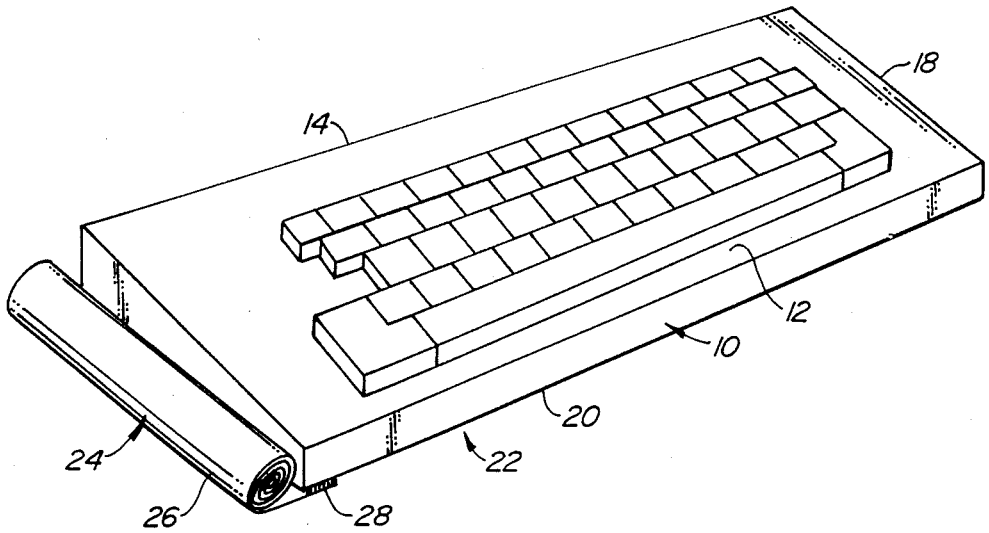
FIG. 2 is a second perspective view of a first embodiment of the invention in a collapsed or rolled-up position.

According to a first embodiment of the invention, a cover 24 for the keyboard 10 comprises an elastic sheet of an elastomeric material, such as polyester film, provided to overlay the face 12 and which extends a length greater than the width of the face 12 and the thickness of the side margins 16 and 18 to engage the underside 22 along opposing margins 16 and 18. The cover 24 is sufficiently stiff to retain a sheet form when spread and a cylindrical shape when rolled in a tube 26 as for example as shown in FIG. 2. When rolled, the sheet 24 may be stored conveniently along one side margin of the keyboard 10. According to the invention, the sheet 24 has a curl characteristic which remembers its shape, having been preformed in a tight roll.

The plastic material is preferably a polyester film such as Dupont Mylar film of preferably about 0.005 inch thickness or at least about 0.001 inch thickness which has been preformed in a tight roll. Mylar is a polyester formed by the condensation of terephthalic acid and ethylene glycol and has a high tensile strength even under elongation. It is a thermoplastic with a melting temperature of about 490 degrees F.

A tight roll of Mylar which holds or remembers its roll shape according to the invention can be formed by heating the material while in a tight roll either before or after it has been cut to the desired sheet shape and form factor of the keyboard. The amount of applied heat is not critical. However, it should be sufficient to cause the material to change its normal flat-sheet characteristic to a normal tight roll. Applying heat to a tight roll of the film material at a temperature above about 120° F. and preferably above about 140° F. in an oven or by means of a hot air blower for about two minutes to uniformly heat the material has been found to be sufficient.

While the exact mechanism is not fully understood, it is believed that the molecular structure of the polyester material changes when it is heated to a transition temperature. Polyester material, particularly Mylar, is characteristically stretchable at ambient (room) temperature, and it strongly resists separation.

The plastic material may be provided with an adhesive strip 28 along the straight edge thereof which abuts the underside 22 of the keyboard 10. The adhesive strip 28 may be of the hook and eye (Velcro)-type or of the glue-type. The adhesive strip 28 may secure the cover 24 to the left or right side margin 16 or 18.

Figure 3:
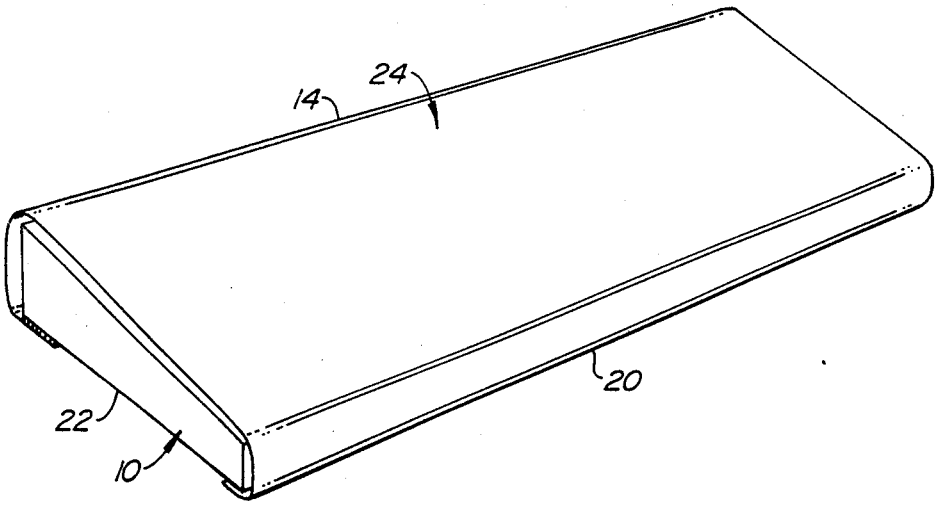
FIG. 3 is a first perspective view of a second embodiment of the invention covering a personal computer keyboard.
Figure 4:
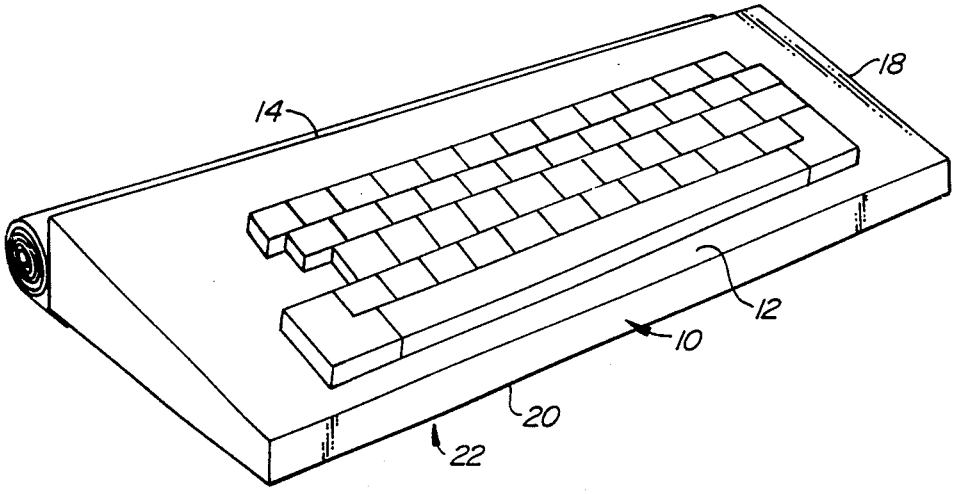
FIG. 4 is a second perspective view of a second embodiment of the cover in the collapsed position.

In FIG. 3, there is shown a second embodiment of a cover 24. The form factor has been selected so that the width is sufficient to extend from the underside 22 of the keyboard 10 at both the top edge 14 and the bottom edge 20. The cover 24 has been preformed in a roll across the height of the keyboard such that the cover 24 will curl to a roll from the bottom edge 20 to the top edge 14 when its margin is lifted away from the bottom edge 20 of the keyboard 10. In FIG. 4, the rest position of a roll 26 after such action according to the invention is shown. The tube 26 can be left in position or removed and stored in a convenient location.

In operation, the cover 24 is drawn across the keyboard 10 from the keyboard side (FIG. 1) or from the keyboard top (FIG. 3) when it is desired to cover the keyboard 10. When it is desired to use the keyboard, the overlapping edge of the cover is simply lifted, allowing the cover automatically to roll into a compact tube 26 to be stored at rest or to be removed to be stored elsewhere.

The invention has now been explained with respect to specific embodiments. Although the foregoing invention has been described in detail for purposes of clarity of understanding, it will be obvious that certain modifications may be practiced within the scope of the appended claims.

What is claimed is:

1. A cover for a computer keyboard, said keyboard having a breadth between first edge margin and a second edge margin, a height between a third edge margin and a fourth edge margin, and a thickness between a face side and an underside, said cover comprising:

a rectilinear sheet of an elastic elastomeric material, said sheet having a length dimension and a width dimension, said sheet being of a sufficient stiffness to be rollable into a cylindrical shape, said length dimension being greater than a sum of said breadth and twice said thickness, said width dimension being greater than a said height, said sheet having a permanent curl characteristic along said length dimension sufficient to cause said sheet to curl into a cylinder whenever at least one margin at ends of said length dimension is released, said sheet for covering said keyboard with opposing margins gripping said first edge margin and said second edge margin and for rolling into a compact cylinder when not covering said keyboard.

2. A cover for a computer keyboard, said keyboard having a breadth between first edge margin and a second edge margin, a height between a third edge margin and a fourth edge margin, and a thickness between a face side and an underside, said cover comprising:

a rectilinear sheet of an elastic elastomeric material, said sheet having a length dimension and a width dimension, said sheet being of a sufficient stiffness to be rollable into a cylindrical shape, said width dimension being greater than a sum of said height and twice said thickness, said length dimension being greater than a said breadth, said sheet having a permanent curl characteristic along said width dimension sufficient to cause said sheet to curl into a cylinder whenever at least one margin at ends of said width dimension is released, said sheet for covering said keyboard with opposing margins gripping said third edge margin and said fourth edge margin and for rolling into a compact cylinder when not covering said keyboard.

3. The keyboard cover according to claim 1 or 2 wherein said sheet is constructed of a film material having a thickness of at least 0.001 inch.

4. The keyboard cover according to claim 1 or 2 wherein said sheet is a polyester film.

5. The keyboard cover according to claim 1 or 2 wherein said sheet is Mylar film and wherein curl is induced by heating said film above ambient temperature while retaining said sheet in a cylindrical shape for a sufficient time and at a sufficient temperature to change the natural flatness of said sheet to a natural curl and then cooling said sheet to ambient temperature while maintaining said sheet in said cylindrical shape.

6. The keyboard cover according to claim 1 or 2 further including means disposed along one margin at the edge of said curl for attaching said sheet at an edge margin of the keyboard.

* * * * *